US005187897A

United States Patent [19]

Maidment

[11] Patent Number: 5,187,897

[45] Date of Patent: Feb. 23, 1993

[54] SWING DOORS

[75] Inventor: Robert A. M. Maidment, Haverhill, United Kingdom

[73] Assignee: Courier Products Limited, United Kingdom

[21] Appl. No.: 848,385

[22] Filed: Mar. 9, 1992

[30] Foreign Application Priority Data

Mar. 14, 1991 [GB] United Kingdom ..... 9105445

[51] Int. Cl.[5] ..... E05D 7/06; E05F 1/14

[52] U.S. Cl. ..... 49/236; 49/381; 49/147; 16/227; 16/280

[58] Field of Search ..... 49/386, 381, 236, 147; 16/227, 280, 309, 282

[56] References Cited

U.S. PATENT DOCUMENTS 4,821,373 4/1989 Maidment et al. ..... 16/227

FOREIGN PATENT DOCUMENTS 2115478 9/1983 United Kingdom .

2189290 10/1987 United Kingdom ..... 16/227

2197022 5/1988 United Kingdom .

*Primary Examiner*—Philip C. Kannan

*Attorney, Agent, or Firm*—Silverman, Cass & Singer, Ltd.

[57] ABSTRACT

In a door and door frame construction the door is hinged to the frame by one or more hinged structures, each hinged structure comprising a convex-surfaced support associated with the door and a convex-surfaced support associated with the door frame, at least two resilient strip-like S-shaped hinge members passing partially round each support and together with the other member forming a letter x or figure 8 configuration as seen in a direction along the supports, respective means being provided fastening together the ends of the members alongside each support so that the members are tensioned round the supports, wherein towards the lower end of the construction each support is provided with a surface raised from the general surface of the support and in contact with the raised surface on the other support.

9 Claims, 2 Drawing Sheets

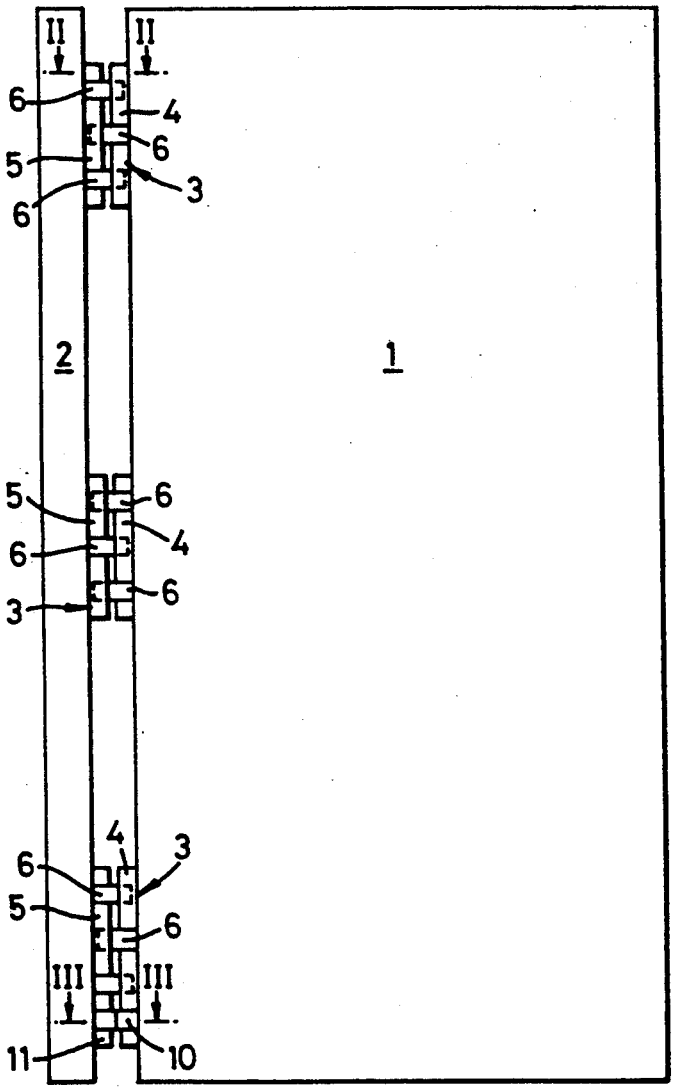
FIG. 1
FIG. 4
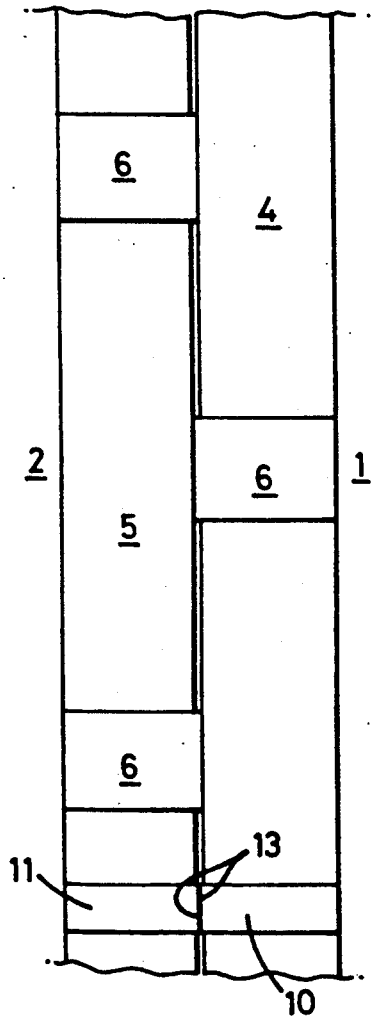

SWING DOORS

This invention relates to swing doors, and especially to self-closing swing doors.

In our Patent Specification GB-A-2115478 we have described a hinged structure comprising two substantially cylindrical supports and one or more hinges hinging the supports together so that they are parallel and closely adjacent, wherein the or each hinge comprises two members each made of resiliently flexible strip material, each member being S-shaped, passing partially round each support and together with the other member forming a letter x or FIG. 8 configuration as seen in a direction along the supports, respective means being provided fastening together the ends of the members alongside each support so that the members are tensioned round the supports.

The hinged structure of that Specification has many applications, and a particular application is in the construction of swing doors. A swing door is for example described in Specification GB-A-2197022. In such a structure one of the hinged supports is, or is attached to, the upright of the door frame, and the other hinged support is attached to the door itself. Suitably the door is connected to the door frame by two or three spaced hinges.

Although the supports described in Specification GB-A-2115478 are substantially cylindrical in section, when the hinge principle of that invention is applied to swing doors it will be more usual for the supports to be part-cylindrical in section, i.e. they will have a convex outer surface for example as shown in FIGS. 4 and 5 of Specification GB-A-2197022. Preferably the supports are made of metal, e.g. aluminium, especially extruded aluminium.

It is an object of the present invention to provide an improved self-closing door based on the hinge principle described above.

According to the invention in a door and door frame construction the door is hinged to the frame by one or more hinged structures, each hinged structure comprising a convex-surfaced support associated with the door and a convex-surfaced support associated with the door frame, at least two resilient strip-like S-shaped hinge members passing partially round each support and together with the other member forming a letter x or FIG. 8 configuration as seen in a direction along the supports, respective means being provided fastening together the ends of the members alongside each support so that the members are tensioned round the supports, wherein towards the lower end of the construction each support is provided with a surface raised from the general surface of the support and in contact with the raised surface on the other support.

Preferably each raised surface has a central flat portion parallel to the vertical edge of the associated door or door frame. Most suitably the raised surface comprises two outer convex portions joined by a central flat portion. The raised surfaces are suitably provided by shaped inserts, e.g. of stainless steel, which are retained in grooves milled from the supports.

The door may be hinged to the door frame by two or more relatively short hinges, or the hinges may extend for the entire length of the door and door frame. The convex-surfaced supports comprising the hinges are suitably made from extruded metal, e.g. aluminium.

An embodiment of the invention will now be described with reference to the accompanying drawings, in which FIG. 1 is a general elevation of a door hinged to a door frame;

FIG. 4 is a detail, on an enlarged scale, of the structure of FIG. 1, showing the lowermost hinge.

Figure 2:
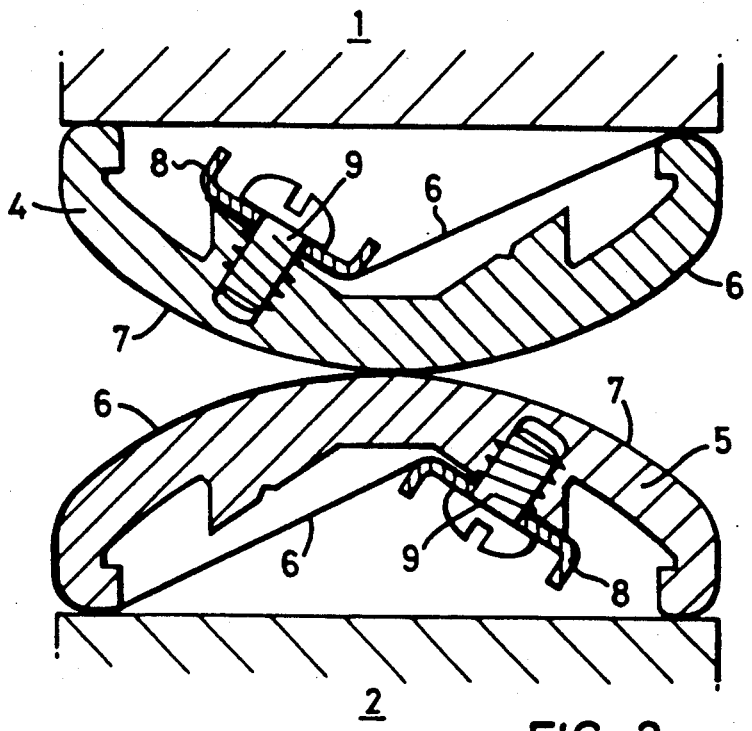
FIG. 2 is a section on the line 2—2 of FIG. 1.

Referring to the drawings, a door 1 is hingedly connected to a door frame 2 by three spaced hinges 3. Each hinge is of the general type described in Specification GB-A-2115478 and Specification GB-A-2197022, and comprises a support 4 attached to the door 1 and a support 5 attached to the door frame 2. The supports 4 and 5 are suitably made from extruded aluminium, and have convex outer surfaces, as better seen in FIG. 2. They are attached together by resilient strips 6, suitably of stainless steel and pre-shaped into the form of an S, the strips 6 passing partially around the supports 4 and 5 and being fastened to the supports in the manner described in Specification GB-A-2115478. The hinges 3 are thus virtually "frictionless", thus enabling extremely smooth opening and closing movements of the door 1.

Figure 3:
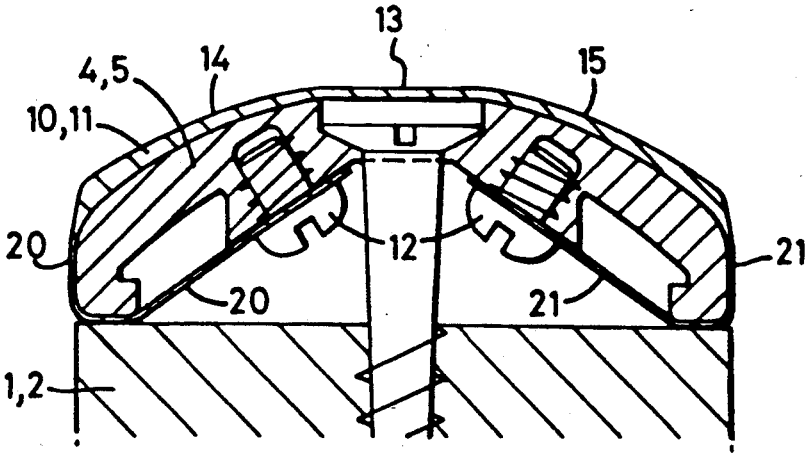
FIG. 3 is a section on the line 3—3 of FIG. 1.

As is better seen from FIGS. 2 and 3, the supports 4 and 5 are of crescent-like form with convex outer surfaces 7 and recessed back portions in which the ends of the strips 6 are fastened by means of plates 8 and screws 9.

The supports 4 and 5 of the lowermost hinge 3 are provided with inserts 10,11 respectively the shape of which is best seen in FIG. 3. The inserts 10,11 are sealed in recesses milled out of the respective supports, and are provided with thin integral webs 20,21 whereby they are attached to the supports by means of screws 12, and each insert comprises a central flat portion 13 bounded by convex-surfaced portions 14 and 15. The curvature of the convex-surfaced portions 14 and 15 is of slightly greater diameter than that of the convex surface of supports 4,5.

When the door 1 is in the closed position, the flat central portions 13 of the inserts 10,11 are in contact, and this enables a stable closed position. When the door 1 is opened, the inserts 10 and 11, which effectively act as a rising cam, are in rolling contact with each other and have the effect of opening slightly the gap between the supports 4 and 5 and slightly lifting the outer edge of the door. When the door is released, its weight and the tension in the hinges tend to return it to the closed position with the flat portions 13 in contact.

I claim:

1. A door and door frame construction in which the door is hinged to the frame by one or more hinged structures, each hinged structure comprising a convex-surfaced support associated with the door and a convex-surfaced support associated with the door frame, at least two resilient strip-like S-shaped hinge members passing partially round each support and together with the other member forming a letter x or FIG. 8 configuration as seen in a direction along the supports, respective means being provided fastening together the ends of the members alongside each support so that the members are tensioned round the supports, wherein towards the lower end of the construction each support is provided with a surface raised from the general surface of the support and in contact with the raised surface on the other support.

2. A construction according to claim 1 wherein each raised surface has a central flat portion parallel to the vertical edge of the associated door or door frame.

3. A construction according to claim 2 wherein each raised surface comprises two outer convex portions joined by a central flat portion.

4. A construction according to claim 2 wherein each support is of generally crescent-like form, with a convex outer surface and a recessed back portion in which the ends of said S-shaped hinge members are fastened.

5. A construction according to claim 1 wherein each raised surface comprises two outer convex portions joined by a central flat portion.

6. A construction according to claim 1 wherein each raised surface is provided by a shaped insert retained in a groove in the respective support.

7. A construction according to claim 1 wherein the convex-surfaced support associated with each of the door and the door frame extends the entire length of the respective door and door frame.

8. A construction according to claim 7 wherein each support is of generally crescent-like form, with a convex outer surface and a recessed back portion in which the ends of said S-shaped hinge members are fastened.

9. A construction according to claim 1 wherein each support is of generally crescent-like form, with a convex outer surface and a recessed back portion in which the ends of said S-shaped hinge members are fastened.

* * * * *